United States Patent [19]

van Rinsum

[11] 4,408,586

[45] Oct. 11, 1983

[54] FUEL INJECTION PUMP

[75] Inventor: Cornelis van Rinsum, Kressbronn, Fed. Rep. of Germany

[73] Assignee: MTU Motoren- und Turbinen-Union Friedrichshaften GmbH, Fed. Rep. of Germany

[21] Appl. No.: 274,188

[22] Filed: Jun. 16, 1981

[30] Foreign Application Priority Data

Jun. 25, 1980 [DE] Fed. Rep. of Germany ..... 3023731

[51] Int. Cl.[3] ..... F02M 39/00

[52] U.S. Cl. ..... 123/446; 123/459

[58] Field of Search ..... 123/446, 495, 457, 459

[56] References Cited

U.S. PATENT DOCUMENTS

| | | | |
|---|---|---|---|
| 2,173,814 | 9/1939 | Bischof | 123/446 |
| 2,950,709 | 8/1960 | Bessiere | 123/446 |
| 4,148,288 | 4/1979 | Steiger | 123/495 |

FOREIGN PATENT DOCUMENTS

| | | | |
|---|---|---|---|
| 585013 | 9/1933 | Fed. Rep. of Germany | 123/446 |
| 613020 | 4/1935 | Fed. Rep. of Germany | 123/495 |
| 92346 | 5/1938 | Sweden | 123/457 |

*Primary Examiner*—Ira S. Lazarus
*Assistant Examiner*—Magdalen Moy
*Attorney, Agent, or Firm*—Craig & Burns

[57] ABSTRACT

A fuel injection pump for diesel engines wherein a delivery valve is arranged in a flow passage or flow route supplying fuel to an injection nozzle. A delivery valve is arranged in the flow route or flow passage of the fuel with a duct, under the control of a further delivery valve, branching off from the flow route or flow passage of the fuel on a downstream side of the first delivery valve. A holding chamber is provided on a discharge side of the further delivery valve, with the holding chamber containing a spring-loaded movable wall and being in communication with a relief chamber by way of a spill port or overflow duct.

11 Claims, 1 Drawing Figure

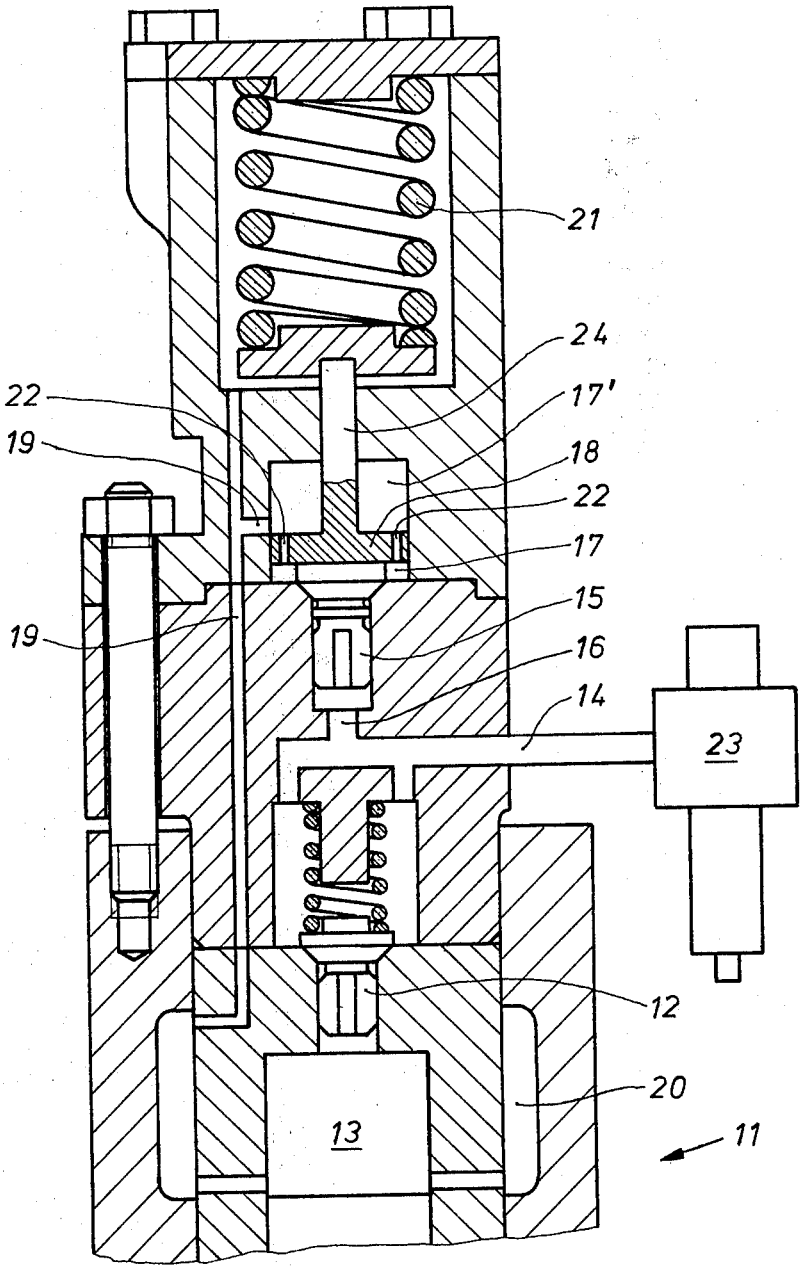
21
24
22
17'
19
18
22
17
15
19
16
14
23
12
20
13
11

FUEL INJECTION PUMP

The present invention relates to an injection pump and, more particularly, to a fuel injection pump for a diesel engine, wherein a delivery valve is arranged in a flow route of the fuel to the injection nozzle, and a duct, under a control of a further delivery valve, branches off from the flow route of the fuel downstream of the delivery valve.

In order to augment or increase the power in a diesel engine without increasing the number of revolutions, in addition to other measures, it is necessary to increase the amount of fuel injected into the engine per operating cycle thereof. For thermodynamic considerations, the injection duration useable for each load stage, measured in degrees of rotation or angular positioning of the cam shaft, is to be kept constant. Thus, an increase of injected quantity of fuel by an injection pump over a prolonged injection period is not feasible.

To obtain a larger injected quantity of fuel with an injection duration remaining the same, the flow cross sections in the injection system must conventionally be enlarged and the geometry of the injection cam must be correspondingly adapted; however, an unavoidable and undesirable side effect of the adapting of the injection cam is that there is a strong rise in peak pressure so that the entire injection system is exposed to great stresses on the material forming such system whereby permissible load limits or load points of the material may be exceeded.

The aim underlying the present invention essentially resides in providing an injection pump for diesel engines which limits a pressure peak which actually occurs with each feed stroke of the injection pump.

In accordance with advantageous features of the present invention, a holding chamber is provided on a discharge side of the further delivery valve, with the holding chamber containing a spring loaded movable wall and being in communication with a relief chamber by way of a spill port.

Advantageously, the wall of the present invention may be constructed as a control piston moving with a valve insert of the further delivery valve.

Advantageously, in accordance with further features of the present invention, at least one throttle bore is arranged in the control piston, with the at least one throttle bore connecting or communicating a front and rear face of the control piston with each other.

Advantageously, an orifice or opening of the spill port 19 is arranged at a peripheral surface of the holding chamber in an operating range of the control piston. Moreover, the relief chamber may form the intake chamber of the injection pump.

It is also possible in accordance with the present invention, for the two delivery valves, the holding chamber with the control piston, and a spring holding the further delivery valve in the closed position to be coaxially arranged.

By virtue of the above-noted features of the present invention, the advantages attain reside especially in the fact that the material stresses caused by the peak pressure in the injection pump as well as in the injection system are reduced. Limitations due to occurring pressure peaks is eliminated by a appropriate selection of the geometry or geometrical configuration for the injection cam and, it is possible for already existing injection pumps to be converted in a relatively economical fashion by the principles of the present invention.

With previously proposed fuel injection pumps operating with a so-called balance pressure relief, the relief or by-pass chamber leads back into the working chamber of the injection pump. However, an amount of fuel discharged through the balanced pressure relief valve impairs a delivery capacity of the injection pump without effecting peak pressure limitations.

In accordance with additional advantageous features of the present invention, the fuel injection pump is equipped with a balanced pressure relief feature. By virtue of the provision of a balanced pressure relief feature, a damping of reflection pressure waves is attained and additional injection is avoided.

Accordingly, it is an object of the present invention to provide a fuel injection pump which avoids, by simple means, shortcomings and disadvantages encountered in the prior art.

Another object of the present invention resides in providing a fuel injection pump for diesel engines which readily makes it possible to increase the power in diesel engines without increasing the speed of revolution thereof.

Yet another object of the present invention resides in providing a fuel injection pump for diesel engines which readily limits an occurrence of pressure peaks with each feed stroke of the injection pump.

A still further object of the present invention resides in providing a fuel injection pump for diesel engines which makes it readily possible to retrofit existing fuel injection pumps.

Yet another object of the present invention resides in providing a fuel injection pump for diesel engines which is simple in construction and therefore relatively inexpensive to manufacture.

A further object of the present invention resides in providing a fuel injection pump for diesel engines which functions realiable under all operating conditions of the diesel engine.

These and other objects, features, and advantages of the present invention will become more apparent from the following description when taken in connection with the accompanying drawing which shows, for the purposes of illustration only, one embodiment in accordance with the present invention, and wherein:

The single FIGURE of the drawing is a longitudinal cross sectional view of a fuel injection pump for a diesel engine constructed in accordance with the present invention.

Referring now to the single figure of the drawing, according to this figure, a fuel injection pump generally designated by the reference numeral 11 for diesel engines is provided with a fuel delivery valve 12 arranged in a flow passage or flow route 14 of fuel between a pump chamber 13 and a fuel injection nozzle 23. A duct 16 branches off from the flow passage or flow route 14 on a discharge side of the delivery valve 12, with the duct 16 leading to a further delivery or pressure valve 15 which control access to a holding chamber 17.

A movable wall such as, for example, formed as a control piston 18, is accommodated in the holding chamber 17. The control piston 18 is urged against a valve insert of the further delivery valve 15 by the bias of a spring 21. The control piston 18 separates a partial volume 17' from the holding chamber 17. Throttle bores 22 are provided in the control piston 18 and are adapted to communicate the holding chamber 17 and partial volume 17' with each other. A spill port or overflow duct 19 extends from the partial volume 17' of the holding chamber and constitutes a connection to a relief chamber, namely, an intake or suction chamber 20 of the fuel injection pump 11. The orifice of the spill port 19 is arranged on the peripheral surface of the partial volume 17' and is separated from the holding chamber 17 in a working range or working displacement of the control piston 18.

Upon a delivery stroke of the fuel injection pump 11, the delivery valve 12 opens up and releases the flow passage 14 to the injection nozzle 23. During this step, a pressure triggering the fuel injection is built up under the control of the valve spring located in the injection nozzle 23. Once a pressure level, as determined by the spring 21 has been reached in the flow passage 14, the further delivery valve 15 begins a stroke movement without initially opening up and, during this step, the control piston 18 is likewise correspondingly shifted or displaced.

The partial volume 17' is filled with fuel and is initially under a pressure of the intake or suction chamber 20 of the injection pump 11. Upon a shifting of the control piston 18, a volume of fuel corresponding to a preliminary stroke of the further delivery valve 15 is displaced by the shifting of the control piston 18 into the intake or suction chamber 20 of the fuel injection pump 11 through the overflow duct 19. The fuel displacement from the partial volume 17' takes place until the control piston 18 closes off the opening of the spill port or overflow duct 19 and the delivery valve is opened after the end of the preliminary stroke. A reduction in the pressure rise of the injection pressure results in correspondence with a displaced fuel volume. A further pressure rise in the flow route 14 and in the duct 16 effects a stroke movement of the further delivery valve 15 against an increasing force of the spring 21. The valve 15 is finally entirely opened so that a communication exists between the flow passage or flow route 14 of the fuel and the holding chamber 17.

Fuel under high pressure may flow through the further delivery valve 15 into the holding chamber 17 in dependence or correspondence with a volume portion of a control piston stem 24 displaced during a stroke of the control piston 18, which likewise results in a pressure reducing effect in the flow route or passage 14. A velocity of a stroke movement of the further delivery valve 15 and the control piston 18 is decelerated or braked by a restriction of the pressure equalization between the holding chambers 17 and the partial volume 17' due to the action of the throttle bores 22. If a still further pressure increase occurs in an injection pressure then, due to the associated further stroke of the control piston 18, the orifice of the spill port or overflow duct 19 is opened toward the holding chamber 17 by a lower control edge of the control piston 18 so that thereby the injection pressure no longer rises inasmuch as fuel can then be discharged from the holding chamber 17 to the intake chamber 20 of the injection pump 11.

Upon an occurrence of a pressure drop in the flow route or passage 14 of the fuel, the orifice of the spill port or overflow duct 19 is once again closed by the control piston 18 under the action of the force stored in the spring 21. A fuel volume then contained in the holding chamber 17 is urged back by the control piston 18, retracted or displaced under the action of the spring 21, through the still opened further delivery valve 15 and the duct 16 into the flow passage or route 14 of the fuel and is not lost for a total amount injected due to this feature.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications are are encompassed by the scope of the appended claims.

I claim:

1. A fuel injection pump for a diesel engine, the pump comprising means for supplying a flow of fuel to a fuel injection nozzle means, and a first delivery valve means arranged in the supply means for controlling a flow of fuel therethrough, a fuel holding chamber means is arranged on a downstream side of the delivery valve means, means are provided for communicating the holding chamber means with the supplying means, a further delivery valve means is provided for controlling a flow of fuel through the communicating means, means are displaceably mounted in the holding chamber means for separating the holding chamber means into two volumes, and in that means are provided for communicating the holding chamber means with a relief chamber means, the separating means is a movable wall member, the means for communicating the holding chamber means with the supplying means is a fuel duct branching off the supplying means on a downstream side of the first delivery valve means, and in that the means for communicating the holding chamber means with the relief chamber means is an overflow duct, characterized in that the further delivery valve means includes a valve insert, spring means are provided for normally urging the wall member in a direction toward the valve insert, the wall member being mounted so as to be movable with the valve insert.

2. A fuel injection pump according to claim 1, characterized in that the movable wall member is formed as a control piston having control edges for controlling an orifice of the overflow duct.

3. A fuel injection pump according to claim 2, characterized in that at least one throttle bore means is provided for communicating the respective volumes of the holding chamber means with each other.

4. A fuel injection pump according to claim 3, characterized in that the orifice of the overflow duct is arranged at a peripheral surface of the holding chamber means in an operating range of the control piston.

5. A fuel injection pump according to claim 4, characterized in that the relief chamber means is an intake chamber of the injection pump.

6. A fuel injection pump according to claim 5, characterized in that the first delivery valve means, second delivery valve means, holding chamber means, control piston, and spring means are coaxially disposed.

7. A fuel injection pump according to claim 6, characterized in that the further delivery valve means includes a valve insert, and in that means are provided for normally urging the separating means into a closed position in engagement with the valve insert.

8. A fuel injection pump according to claim 7, characterized in that means are provided in the separating means for communicating the volumes of the holding chamber means with each other.

9. A fuel injection pump according to claim 8, characterized in that means are provided on the separating means for controlling the means communicating the holding chamber means with the relief chamber means.

10. A fuel injection pump for a diesel engine, the pump comprising means for supplying a flow of fuel to a fuel injection nozzle means, and a first delivery valve means arranged in the supply means for controlling a flow of fuel therethrough, a fuel holding chamber means is arranged on a downstream side of the delivery valve means, means are provided for communicating the holding chamber means with the supplying means, a further delivery valve means is provided for controlling a flow of fuel through the communicating means, means are displaceably mounted in the holding chamber means for separating the holding chamber means into two volumes, and in that means are provided for communicating the holding chamber means with a relief chamber means, the separating means is a movable wall member, the means for communicating the holding chamber means with the supplying means is a fuel duct branching off the supplying means on a downstream side of the first delivery valve means, and in that the means for communicating the holding chamber means with the relief chamber means is an overflow duct, the further delivery valve means includes a valve insert, spring means are provided for normally urging the wall member in a direction toward the valve insert, the wall member being mounted so as to be movable with the valve insert, characterized in that the relief chamber means is an intake chamber of the injection pump.

11. A fuel injection pump for a diesel engine, the pump comprising means for supplying a flow of fuel to a fuel injection nozzle means, and a first delivery valve means arranged in the supply means for controlling a flow of fuel therethrough, a fuel holding chamber means is arranged on a downstream side of the delivery valve means, means are provided for communicating the holding chamber means with the supplying means, a further delivery valve means is provided for controlling a flow of fuel through the communicating means, means are displaceably mounted in the holding chamber means for separating the holding chamber means into two volumes, and in that means are provided for communicating the holding chamber means with a relief chamber means, the separating means is a movable wall member, the means for communicating the holding chamber means with the supplying means is a fuel duct branching off the supplying means on a downstream side of the first delivery means, and in that the means for communicating the holding chamber means with the relief chamber means is an overflow duct, the further delivery valve means includes a valve insert, spring means are provided for normally urging the wall member in a direction toward the valve insert, the wall member being mounted so as to be movable with the valve insert, characterized in that the first delivery valve means and the further delivery valve means are coaxially arranged with respect to one another.

* * * * *